United States Patent [19]

Murakami et al.

[11] Patent Number: 4,807,853

[45] Date of Patent: Feb. 28, 1989

[54] CONTINUOUS FURNACE FOR GAS CARBURIZING AND HARDENING

[75] Inventors: Koji Murakami, Settsu; Tsunao Shima, Ikoma; Yoshikazu Shimosato, Yahata; Akira Yokoyama, Okayama, all of Japan

[73] Assignee: Chugai Ro Co., Ltd., Japan

[21] Appl. No.: 882,420

[22] Filed: Jul. 7, 1986

Related U.S. Application Data

[62] Division of Ser. No. 686,207, Dec. 26, 1984, abandoned.

[30] Foreign Application Priority Data

Dec. 27, 1983 [JP] Japan ..... 58-247174

[51] Int. Cl.[4] ..... C21D 11/00

[52] U.S. Cl. ..... 266/81; 266/250; 266/252; 266/259

[58] Field of Search ..... 266/130, 249, 250, 251, 266/252, 259, 78, 81, 90

[56] References Cited

U.S. PATENT DOCUMENTS

| | | | |
|---|---|---|---|
| 3,356,541 | 12/1967 | Cullen | 266/252 |
| 3,662,996 | 5/1972 | Schwalm | 266/130 |
| 4,118,016 | 10/1978 | Westeren et al. | 266/130 |

FOREIGN PATENT DOCUMENTS

| | | | |
|---|---|---|---|
| 6827 | 1/1979 | Japan | 148/16.6 |
| 577254 | 11/1977 | U.S.S.R. | 148/166 |
| 730875 | 5/1980 | U.S.S.R. | 266/250 |
| 765379 | 9/1986 | U.S.S.R. | 148/16.6 |

OTHER PUBLICATIONS

Shupin, "Modern Trends in Heat Treat Technology", Heat Treatment Technology, Aug. 1974, pp. 668–672.

Metals Handbook, vol. 4, Heat Treating, ©1981, 9th ed., pp. 270–273, 307, 308.

*Primary Examiner*—Christopher W. Brody

*Attorney, Agent, or Firm*—Jackson & Jones

[57] ABSTRACT

A method of gas carburizing and hardening a steel article and a continuous furnace therefor. The method includes the steps of carburizing the article in a carburizing atmosphere at atmospheric pressure, heating the article in a vacuum for a predetermined period of time, and hardening the article.

19 Claims, 4 Drawing Sheets

CONTINUOUS FURNACE FOR GAS CARBURIZING AND HARDENING

This is a divsion of application Ser. No. 686,207, filed Dec. 26, 1984, now abandoned.

BACKGROUND OF THE INVENTION

The present invention generally relates to heat treatment and more particularly, to a method of gas carburizing and hardening steel articles and a continuous furnace therefor.

It has been conventionally known that processes of gas carburizing and hardening of steel articles comprise a heating step of heating the steel articles to a carburizing temperature, a carburizing step of holding the steel articles in a carburizing atmosphere for a predetermined period of time so as to cause carbon to be absorbed into surfaces of the steel articles, a diffusing step of diffusing the absorbed carbon into the steel articles, and a hardening step of cooling the steel articles so as to harden the steel articles. Meanwhile, the processes of gas carburizing and hardening the steel articles are classified, in accordance with pressures in furnaces at the carburizing step and the diffusing step, into a gas carburizing and hardening method in which the steel articles are heat treated in the vicinity of atmospheric pressure by using an endothermic atmosphere or a mixture of $N_2$ gas and a hydrocarbon gas, and a vacuum carburizing and hardening method in which the steel articles are heat treated at subatmospheric pressure by using a mixture of $N_2$ gas and a hydrocarbon gas or the hydrocarbon gas only. The gas carburizing and hardening method has such an advantage as to enable a continuous furnace to have a simple construction but is disadvantageous not only in that the processed steel articles assume so-called carburizing colors such as a grayish brown color, a grayish black color, etc. but in that a quenching media becomes rapidly deteriorated, thereby resulting in a short life thereof. On the other hand, in the vacuum carburizing and hardening method, the steel articles have bright surfaces without assuming the carburizing colors and the quenching media has a long life. However, the vacuum carburizing and hardening method has such an inconvenience that since a plurality of chambers each separated by a vacuum partition door from one another are required to be provided in order to produce a continuous furnace, the continuous furnace becomes complicated in structure.

Meanwhile, the above described carburizing colors are produced by chromic oxides formed on the surfaces of the processed articles during the gas carburizing process or soot adhering to the surfaces of the processed articles during the gas carburizing process. It is known that when an article having a carburizing color is heated at about 900° C. in a vacuum of $10^{-1}$ to $10^{-2}$ torr, dissociation of oxygen is effected due to drop in partial pressure of oxygen such that the processed article has a bright surface.

SUMMARY OF THE INVENTION

Accordingly, an essential object of the present invention is to provide an improved method of gas carburizing and hardening a steel article and an improved continuous furnace therefor, by which the processed article has a bright surface and is reduced in amount of intergranular oxidation layers, with substantial elimination of the disadvantages inherent in conventional methods and continuous furnaces of this kind.

In accomplishing these and other objects according to one preferred embodiment of the present invention, there is provided an improved method of gas carburizing and hardening a steel article, comprising the steps of: carburizing said steel article in a carburizing atmosphere at atmospheric pressure; heating said steel article in a vacuum for a predetermined period of time; and hardening said steel article.

In accordance with the present invention, since the advantages of the prior art two methods, i.e. the advantages of the gas carburizing and hardening method and the vacuum carburizing and hardening method are combined, the steel articles can be continuously heat treated in aerobic conditions.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
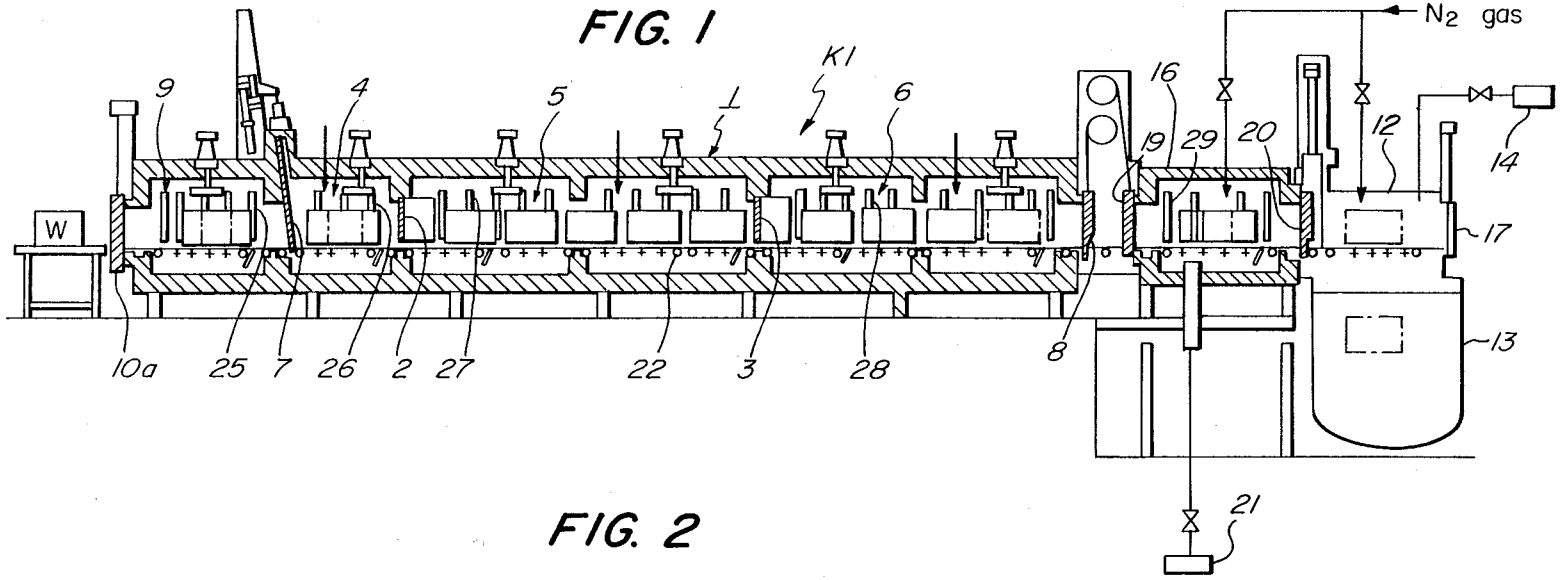
FIG. 1 is a schematic vertical sectional view of a continuous furnace including a plurality of chambers, according to a first embodiment of the present invention.
Figure 2:
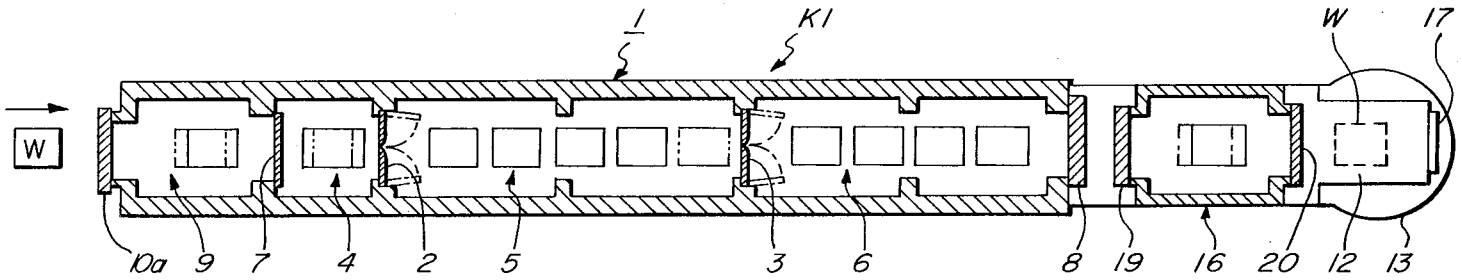
FIG. 2 is a schematic horizontal sectional view of the continuous furnace of FIG. 1.
Figure 3:
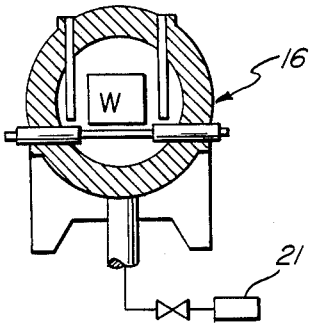
FIG. 3 is a cross-sectional view of a vacuum heating chamber employed in the continuous furnace of FIG. 1.

Referring now to the drawings, there is shown in FIGS. 1 to 3, a continuous furnace K1 for continuously gas carburizing and hardening metal articles W, according to a first embodiment of the present invention. The continuous furnace K1 includes a carburizing apparatus 1, a vacuum heating chamber 16 and a hardening apparatus 12 provided with an oil quenching tank 13 and an elevator (not shown), which are longitudinally arranged in this order. The carburizing apparatus 1 includes a loading vestibule 9 having a loading door 10*a*, a heating chamber 4, a carburizing chamber 5 and a diffusing chamber 6 having a discharge door 8, which are longitudinally arranged in this order. Partition doors 7, 2 and 3 are, respectively, provided between the loading vestibule 9 and the heating chamber 4, between the heating chamber 4 and the carburizing chamber 5 and between the carburizing chamber 5 and the diffusing chamber 6. Either an endothermic gas composed of 20 to 25% by volume of CO and 30 to 40% by volume of $H_2$ or $N_2$ gas is introduced into the heating chamber 4, while a carburizing atmosphere, which is a mixture of a hydrocarbon gas (e.g. propane) and either one of the above endothermic gas and $N_2$ gas, is introduced into the carburizing chamber 5 and the diffusing chamber 6. The hardening apparatus 12 is provided with a discharge door 17, while the vacuum heating chamber 16 is provided with a loading door 19 and a discharge door 20 so as to be coupled with the hardening apparatus 12.

Meanwhile, the hardening apparatus 12 is connected with an evacuation device 14, while the vacuum heating chamber 16 is connected with an evacuation device 21. It is so arranged that $N_2$ gas is supplied into the hardening apparatus 12 and the vacuum heating chamber 16. Furthermore, the continuous furnace K1 includes rollers 22 for conveying the articles W. The loading vestibule 9, heating chamber 4, carburizing chamber 5, diffusing chamber 6 and vacuum heating chamber 16, except for the hardening apparatus 12, are provided with heating devices 25, 26, 27, 28 and 29, respectively.

Figure 5:
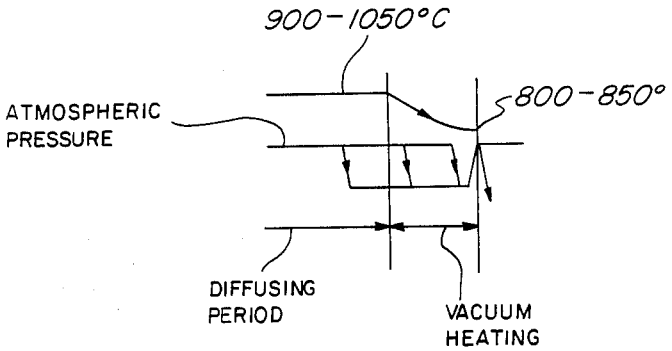
FIG. 5 is a graph showing temperature and pressure in the vacuum heating chamber of FIG. 3.

Hereinbelow, operations of the continuous furnace K1 will be described with reference to FIGS. 4 and 5. FIGS. 4*d* and 4*e* show temperature and pressure in the chambers of the continuous furnace K1, respectively.

EXAMPLE 1

A round rod made of chromium steel SCr415 (JIS) and a gear made of chromium steel SCr420 (JIS) are employed as the articles W and are treated on the following conditions.

(1) Carburizing process
  (1) Carburizing temperature=930° C.
  (2) Carburizing period
    a. Carbon potential=1.1%
    b. Processing time period=105 min.
  (3) Diffusing period
    a. Carbon potential=0.8%
    b. Processing time period=45 min.

(2) Vacuum heating process

After the diffusing process, the articles W are held in a vacuum of $10^{-2}$ torr at a furnace temperature of 930° C. for 30 min.

(3) Hardening process

The articles W are subjected to oil quenching directly from the carburizing temperature of 930° C.

The results of the above treatment are as follows.

The round rod made of SCr415 and the gear made of SCr420 have bright surfaces and are formed with intergranular oxidation layers of 4 to 8 microns in thickness.

EXAMPLE 2

A round rod made of SCr415 and a gear made of SCr420 are employed as the articles W in the same manner as in the above Example 1 and are treated on the following conditions.

(1) Carburizing process
  (1) Carburizing temperature=930° C.
  (2) Carburizing period
    a. Carbon potential=1.1%
    b. Processing time period=105 min.
  (3) Diffusing period
    a. Carbon potential=0.8%
    b. Processing time period=45 min.

(2) Vacuum heating process

The articles W are held in a vacuum of $10^{-2}$ torr for 30 min. during which temperature of the articles W drops to a hardening temperature of 850° C. after the diffusing process.

(3) Hardening process

The articles W are subjected to oil quenching immediately after the temperature of the articles W has dropped to the hardening temperature of 850° C.

The results of the above treatment are as follows.

The round rod made of SCr415 and the gear made of SCr420 have bright surfaces and are formed with intergranular oxidation layers of 5 to 10 microns in thickness.

EXAMPLE 3

A round rod made of chromium molybdenum steel SCM420H (JIS) is employed as the article W and is treated on the following conditions.

(1) Carburizing process
  (1) Carburizing temperature=930° C.
  (2) Carburizing period
    a. Carbon potential=1.1%
    b. Processing time period=120 min.

(2) Vacuum heating process

The article W is held in a vacuum of $5\times10^{-2}$ torr not only for a diffusing period of 30 min. after the carburizing period but for 20 min. during which temperature of the article W drops to a hardening temperature of 850° C. after the diffusing process.

(3) Hardening process

The article W is subjected to oil quenching immediately after the temperature of the article W has dropped to the hardening temperature of 850° C.

The results of the above treatment are as follows.

The round rod made of SCM420H has a bright surface and is formed with abnormal surface structure (troostitic layers) of not more than 5 microns in thickness.

COMPARATIVE EXAMPLE

When the articles W are not subjected to the vacuum heating process in the above Examples 1 to 3, namely the articles W are subjected to the oil hardening process directly after the diffusing process, the articles W have the carburizing colors such as grayish brown color, grayish black color, etc. and are formed with intergranular oxidation layers of 15 to 20 microns in thickness.

Figures 4A, 4B, 4C, 4D, 4E:
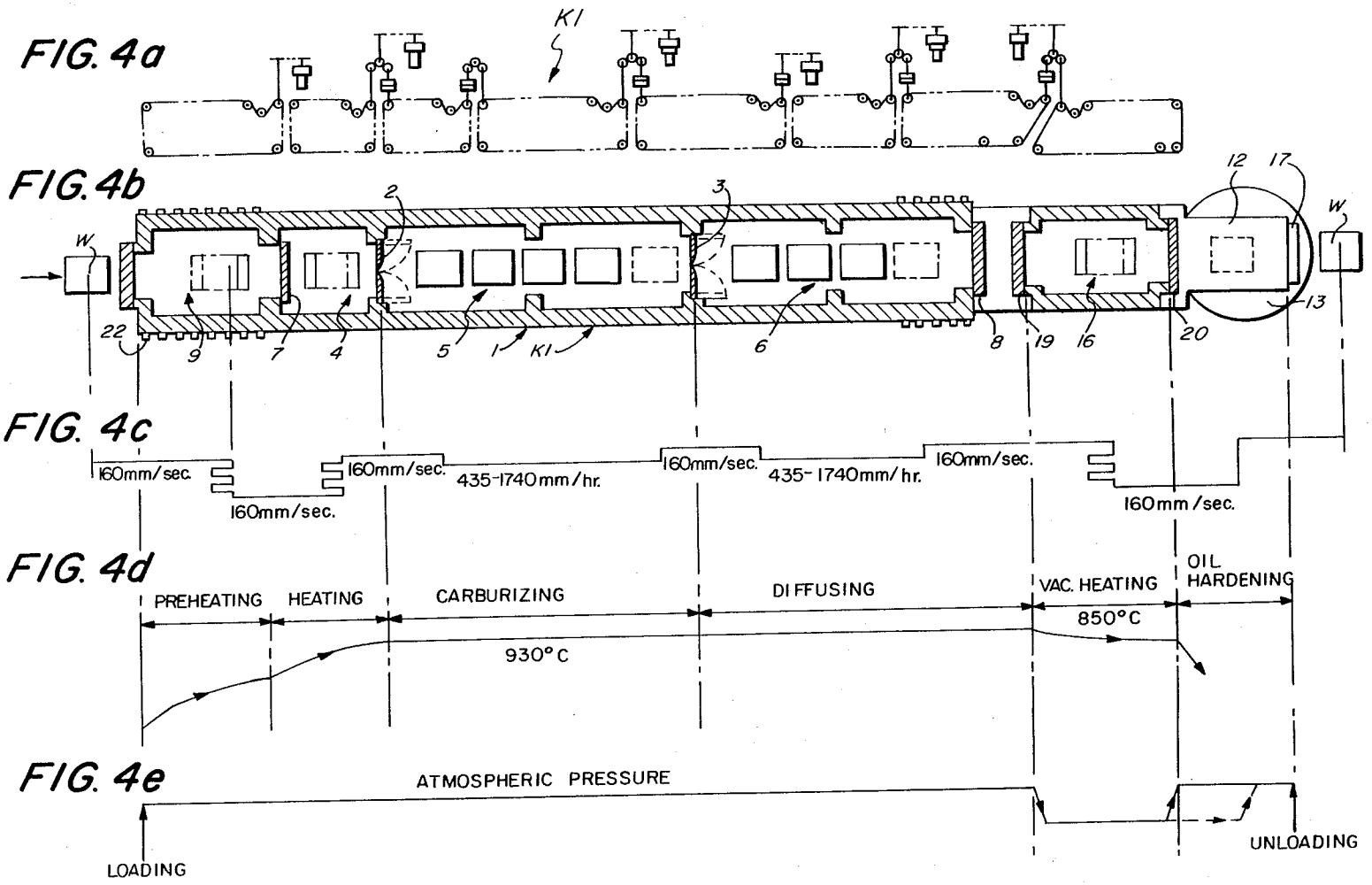
FIG. 4*a* is a schematic view of a plurality of drive units for driving rollers for conveying steel articles, which are employed in the continuous furnace of FIG. 1.
FIG. 4*b* is a view similar to FIG. 2, particularly showing the rollers driven by the driving units of FIG. 4*a;*
FIG. 4*c* is a chart indicative of transfer speed and path of the steel articles at the respective chambers.
FIGS. 4*d* and 4*e* are graphs showing temperature and pressure in the chambers of the continuous furnace of FIG. 1, respectively.

As shown in FIG. 4*a*, the continuous furnace K1 includes a plurality of drive units for driving the rollers 22 for conveying the articles W. Each of the articles W is conveyed by the drive units at different speeds in the furnace K1 so as to be oscillated in a path of the articles W as shown in FIG. 4*c*. In the furnace K1, it is so arranged that as soon as the article W has been loaded into the vacuum heating chamber 16, the vacuum heating chamber 16 is evacuated to a vacuum by the evacuation device 21 as shown in FIG. 4*e*. However, it was found that the articles W have bright surfaces and are formed with decreased intergranular oxidation layers even in the case where the vacuum heating chamber 16 is evacuated to a vacuum in the course of drop of temperature therein during the vacuum heating process or after drop of the temperature of the articles W to the hardening temperature of 850° C., or prior to drop of the temperature of the articles W to the hardening temperature, e.g. the vacuum heating chamber 16 is evacuated to a vacuum during the diffusing period such that part of the diffusing process is performed in the vacuum heating chamber 16 as shown in FIG. 5. Namely, in the case where the temperature of the articles W is lowered to the hardening temperature after the carburizing process, a decision as to when the vacuum heating process is started is made in accordance with amount of the articles W to be treated and piling conditions of the articles W. Meanwhile, in the case where the articles W are subjected to the hardening process immediately after the carburizing process, the articles W are subjected to the vacuum heating process during a latter part of the diffusing period.

It is to be noted that the hardening apparatus 12 is not limited to the oil quenching apparatus but a gas cooling apparatus can be employed as the hardening apparatus 12 in place of the oil quenching apparatus. Furthermore, the hardening apparatus 12 is not necessarily required to be provided with the evacuation device 14. However, when the hardening apparatus 12 is provided with the evacuation device 14 such that a controlled atmosphere or $N_2$ gas is introduced into the hardening apparatus 12 after the hardening apparatus 12 has been evacuated to a vacuum, the amount of the controlled atmosphere or $N_2$ gas drawn into the hardening apparatus 12 is less than that in the case of purging the interior of the hardening apparatus 12 with the controlled atmosphere, thus resulting in a more economical operation.

Figure 6:
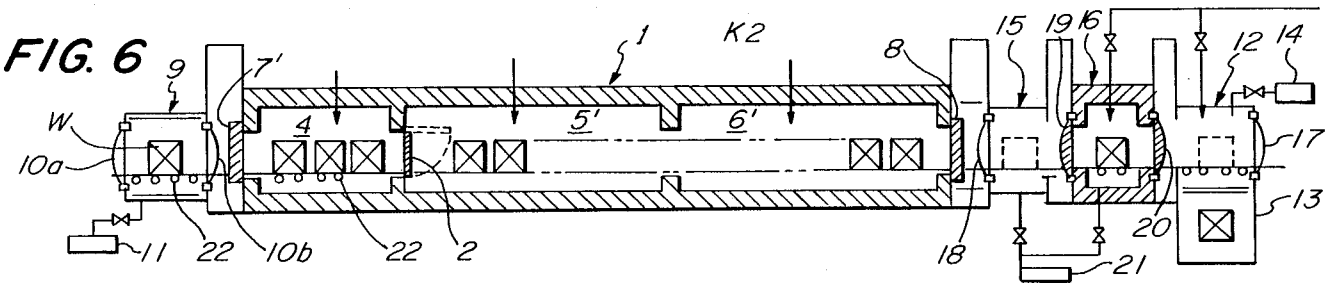
FIG. 6 is a view similar to FIG. 1, particularly showing a continuous furnace according to a second embodiment of the present invention.

Referring to FIG. 6, there is shown a continuous furnace K2 according to a second embodiment of the present invention. The continuous furnace K2 includes the loading vestibule 9 having the loading door 10*a* and a discharge door 10*b*, the carburizing apparatus 1 provided separately from the loading vestibule 9, a purge chamber 15 having a loading door 18, the vacuum heating chamber 16 and the hardening device 12 provided with the oil quenching tank 13. The carburizing apparatus 1 includes the heating chamber 4 having a loading door 7', a carburizing zone 5' and a diffusing zone 6'. The continuous furnace K2 includes the partition door 2 for separating the heating chamber 4 from the carburizing zone 5' as in the continuous furnace K1 but is not provided with the partition door 3 of the continuous furnace K1 for separating the carburizing zone 5' from the diffusing zone 6'. The loading vestibule 9 is connected with an evacuation device 11. The purge chamber 15 is coupled, through the vacuum heating chamber 16, with the hardening. apparatus 12. The purge chamber 15 and the vacuum heating chamber 16 are connected with the evacuation device 21. Since other constructions of the continuous furnace K2 are similar to those of the continuous furnace K1, detailed description thereof is abbreviated for the sake of brevity.

Figure 7A:
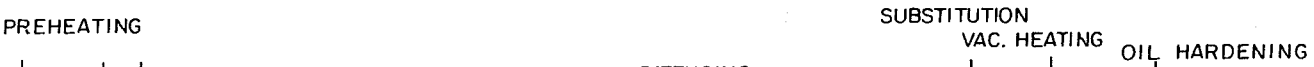
FIGS. 7*a* and 7*b* are graphs indicative of temperature and pressure in the chambers of the continuous furnace of FIG. 6, respectively.
Figure 7B:
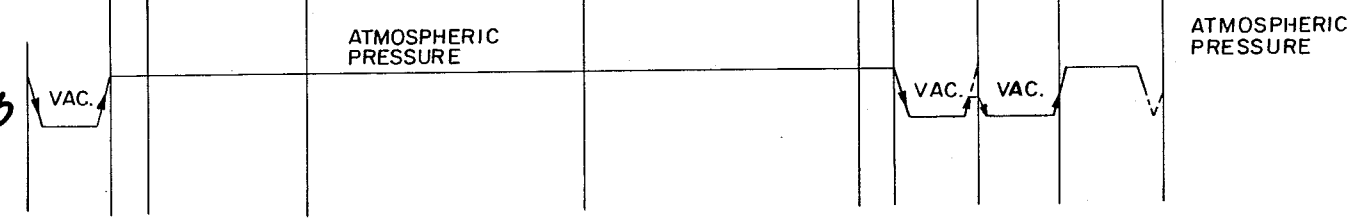

Hereinbelow, operations of the continuous furnace K2 will be described with reference to FIGS. 7*a* and 7*b* showing temperature and pressure in the chambers of the continuous furnace K2, respectively. After the article W made of chromium molybdenum steel SCM420 (JIS), etc. has been loaded into the loading vestibule 9, the evacuation device 11 is actuated so as to evacuate the loading vestibule 9 to a vacuum and, at the same time, the article W is preheated to temperatures of 400° to 600° C. by a heating device (not shown) so as to remove from the article W impurities adhering thereto. After the article W has been preheated, $N_2$ gas is introduced into the loading vestibule 9 so as to restore the interior of the loading vestibule 9 to atmospheric pressure. Subsequently, the article W is loaded into the heating chamber 4 by opening the discharge door 10*b* of the loading vestibule 9 and the loading door 7' of the carburizing apparatus 1. After the article W has been heated to a carburizing temperature of about 950° C. by a heating device (not shown) in the heating chamber 4, the article W is sequentially subjected to the carburizing process in the carburizing zone 5' and the diffusing process in the diffusing zone 6'. The carburizing process is performed at a carbon potential of 1.0% for 150 min., while the diffusing process is performed at a carbon potential of 0.9% for 90 min.

Thus, when the carburizing process and the diffusing process have been completed, the article W is conveyed into the purge chamber 15 by opening the discharge door 8 of the carburizing apparatus 1 and the loading door 18 of the purge chamber 15. Then, the discharge door 8 and the loading door 18 are closed. When the article W has been transported into the purge chamber 15, the interior of the purge chamber 15 and the vacuum heating chamber 16 is maintained at a vacuum of about $10^{-2}$ torr by the evacuation device 21. Thereafter, the article W is loaded into the vacuum heating chamber 16 by opening the loading door 19 of the heating chamber 16 so as to be held in a vacuum of about $10^{-2}$ torr in the vacuum heating chamber 16 for about 30 min. until the temperature of the article W drops to the oil quenching temperature of, for example, 850° C. Meanwhile, the hardening apparatus 12 is evacuated to a vacuum of about $10^{-2}$ torr by the evacuation device 14. When the temperature of the article W has dropped to the hardening temperature in the vacuum heating chamber 16, $N_2$ gas is directed into the vacuum heating chamber 16 and the hardening apparatus 12 so as to restore the interior of the vacuum heating chamber 16 and the hardening apparatus 12 substantially to atmospheric pressure. Subsequently, the article W is loaded into the hardening apparatus 12 by opening the discharge door 20 of the vacuum heating chamber 16. Then, the article W is subjected to oil quenching by dipping the article W into oil in the oil quenching tank 13 by the use of the elevator (not shown). After completion of the oil quenching, the article W is carried out of the hardening apparatus 12 by opening the discharge door 17 of the hardening apparatus 12, whereby the carburizing process and the hardening process of the article W have been completed.

Although the loading vestibule 9 is provided with the evacuation device 11 in the continuous furnace K2, it can be also so arranged that, by eliminating the evacuation device 11, the interior of the loading vestibule 9 is purged with a protective controlled atmosphere or the above described carburizing atmosphere after the article W has been loaded into the loading vestibule 9. However, when the loading vestibule 9 is provided with the evacuation device 11 as in the continuous furnace K2, the amount of the controlled atmosphere required therefor becomes small, thereby making the carburizing process less expensive.

Furthermore, the purge chamber 15 is not necessarily required to be provided in the continuous furnace K2. In any case, by heating the gas carburized article W in the vacuum heating chamber 16, the article W has a bright surface and is formed with decreased intergranular oxidation layers through dissociation of $O_2$.

As is clear from the foregoing description, in accordance with the method of the present invention, since the vacuum heating process is provided between the carburizing process and the hardening process which are performed at atmospheric pressure, production of the carburizing colors associated with the gas carburizing and hardening method is prevented, so that the treated articles have bright surfaces and are formed with decreased intergranular oxidation layers without employing the vacuum carburizing and hardening method and the continuous furnace can be simplified in structure.

Moreover, in accordance with the continuous furnace of the present invention, since the vacuum heating chamber is provided between the carburizing apparatus and the hardening apparatus and the hardening apparatus is connected with the evacuation device, the continuous furnace has been simplified in structure and lowered in cost as compared with continuous furnaces for vacuum carburizing and hardening.

In addition, in accordance with the present invention, it is possible to continuously gas carburize and harden the articles such that the articles have bright surfaces similar, in color, to the material without assuming the carburizing colors and are formed with decreased intergranular oxidation layers which ensure high wear resistance and high durability of the articles.

Furthermore, in accordance with the present invention, even in the case where the articles are subjected to oil hardening, soot does not adhere to the surfaces of the articles due to the vacuum heating process in the vacuum heating chamber, thus resulting in long life of the quenching media.

Moreover, in accordance with the present invention, in the case where the loading vestibule is evacuated to a vacuum by the evacuation device, a required amount of the controlled atmosphere becomes small, so that operations of the continuous furnace are economical, while entry of air into the carburizing apparatus is prevented by the loading vestibule and the vacuum heating chamber such that seasoning of the articles can be performed at an early stage.

In addition, in accordance with the present invention, since the loading vestibule is provided with the evacuation device and the heating device, it becomes unnecessary to provide a washing device prior to treatment of the articles.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A continuous heat treating furnace for forming a carburized case on a steel article, wherein the objects are continuously and sequentially transported through furnace chambers which include a loading chamber, an carburizing chamber, a diffusing chamber, and a hardening chamber, said furnace comprising:

a loading vestibule;

a gas carburizing chamber connected in tandem with said loading vestibule;

a vacuum heating chamber connected in tandem with said gas carburizing chamber;

a vacuumized hardening chamber connected in tandem with said vacuum heating chamber;

transport means for transporting said steel article continuously and in sequence from said loading vestibule through said gas carburizing chamber, said vacuum heating chamber, and to said hardening chamber;

said gas carburizing chamber including a heating zone, a carburizing zone and a diffusing zone and means supplying a carburizing gas at atmospheric pressure thereto such that said heating zone, said carburizing zone and said diffusing zone are maintained at first, second and third predetermined carbon potentials, respectively, whereby chrome and manganese oxides are formed during carburization on the case of said carburized steel article; and wherein the improvement is further characterized as comprising:

said vacuum heating chamber being connected between said gas carburizing chamber in which the carbon potential is being controlled and the vacuumized hardening chamber, said vacuum heating chamber characterized by a heating means and a first evacuation means for holding said heating chamber under vacuum for not less than twenty minutes while the temperature of said steel article is brought to it's hardening temperature under vacuum and is held at that hardening temperature for the stated time; and said hardening chamber being characterized by a second evacuation means for causing said hardening chamber to be evacuated to a vacuum prior to a hardening treatment of said steel article in said evacuated hardening chamber, whereby oxygen is dissociated, from chrome oxides and manganese oxides formed in said steel article in said gas carburizing chamber.

2. A continuous furnace as claimed in claim 1, wherein said vacuum heating chamber includes a purge chamber connected with said first evacuation device.

3. A continuous furnace as claimed in claim 1, wherein said loading vestibule is bounded by a loading door and a first partition door of said gas carburizing furnace, which are disposed at a loading side of said gas carburizing furnace.

4. A continuous furnace as claimed in claim 1, wherein said loading vestibule is disposed forwardly of said gas carburizing furnace so as to be coupled therewith and is bounded by a loading door and a discharge door.

5. A continuous furnace as claimed in claim 3, wherein said loading vestibule includes a second heating means.

6. A continuous furnace as claimed in claim 4, wherein said loading vestibule includes a second heating means.

7. A continuous furnace as claimed in claim 4, wherein said loading vestibule includes a third evacuation device.

8. A continuous furnace as claimed in claim 5, wherein said gas carburizing furnace is separated into a heating chamber and a carburizing and diffusing chamber by a second partition door provided at a predetermined position in said gas carburizing furnace.

9. A continuous furnace as claimed in claim 7, wherein said gas carburizing furnace is separated into a heating chamber and a carburizing and diffusing chamber by a second partition door provided at a predetermined position in said gas carburizing furnace.

10. A continuous furnace as claimed in claim 5, wherein said gas carburizing furnace is separated into a heating chamber, a carburizing chamber and a diffusing chamber by a second partition door and a third partition door which are provided at predetermined positions in said gas carburizing furnace, respectively.

11. A continuous furnace as claimed in claim 7, wherein said gas carburizing furnace is separated into a heating chamber, a carburizing chamber and a diffusing chamber by a second partition door and a third partition door which are provided at predetermined positions in said gas carburizing furnace, respectively.

12. A continuous furnace as claimed in claim 3, wherein said conveyor means is formed by a plurality of groups of roller conveyors.

13. A continuous furnace as claimed in claim 4, wherein said conveyor means is formed by a plurality of groups of roller conveyors.

14. A continuous furnace as claimed in claim 8, wherein said conveyor means is formed by a plurality of groups of roller conveyors.

15. A continuous furnace as claimed in claim 9, wherein said conveyor means is formed by a plurality of groups of roller conveyors.

16. A continuous furnace as claimed in claim 10, wherein said conveyor means is formed by a plurality of groups of roller conveyors.

17. A continuous furnace as claimed in claim 11, wherein said conveyor means is formed by a plurality of groups of roller conveyors.

18. A continuous heat treating furnace for carburizing and hardening metallic objects which are continuously and sequentially passed through a gas carburizing furnace followed by an evacuated heating chamber and an evacuated hardening chamber, said heat treating furnace comprising:

a gas carburizing furnace for gas carburizing the metallic objects including a heating device and a housing member having an internal chamber connected with the heating device and maintained at atmospheric pressure for carburizing metallic objects;

means for controlling the carbon potential in the atmosphere of said gas carburizing furnace wherein oxide layers are produced on said metallic objects during carburizing by said carburizing furnace;

a vacuum heating chamber connected in tandem with said gas carburizing furnace for receiving the carburized metallic objects subsequent to their treatment in the gas carburizing furnace, said heating chamber including a first evacuation device for maintaining a heating chamber at a substantially subatmospheric pressure for a predetermined time period, and also including means for maintaining the chamber at a temperature significantly higher than ambient; and an evacuated hardening chamber connected in tandem with said vacuum heating chamber for vacuum quenching the metallic objects, after their treatment in said vacuum heating chamber, to a significantly lower temperature than the temperature of the vacuum heating chamber, whereby the combination of both the level of subatmospheric pressure and the time period in said vacuum heating chamber are of sufficient magnitude to provide bright surfaces and intergranular oxidation layers of less than 15 microns in thickness to the metallic objects when hardened in said evacuated hardening chamber.

19. A continuous heat treating furnace for forming a carburized case on a steel article, wherein the objects are continuously and sequentially transported through furnace chambers which include a loading chamber, a carburizing chamber, a diffusing chamber, and a hardening chamber, said furnace comprising:

a loading vestibule;

a gas carburizing chamber connected in tandem with said loading vestibule;

a vacuum heating chamber connected in tandem with said gas carburizing chamber;

a vacuumized hardening chamber connected in tandem with said vacuum heating chamber;

transport means for transporting said steel article continuously and in sequence from said loading vestibule through said gas carburizing chamber, said vacuum heating chamber, and said hardening chamber;

said gas carburizing chamber including a heating zone, a carburizing zone and a diffusing zone and means supplying a carburizing gas thereto at atmospheric pressure such that said heating zone, said carburizing zone and said diffusing zone are maintained at first, second and third predetermined carbon potentials, respectively, whereby oxides are formed on the carburized case of said steel article; and wherein the improvement is further characterized as comprising:

said vacuum heating chamber being connected between said gas carburizing chamber in which the carbon potential is being controlled and the vacuumized hardening chamber, said vacuum heating chamber characterized by a heating means and an evacuation means for holding said heating chamber under vacuum for not less than twenty minutes while the temperature of said steel article is brought to it's hardening temperature under vacuum and is held at that hardening temperature for the stated time whereby oxygen from the oxides formed in said steel article in said gas carburizing chamber are dissociated, in said vacuum heating chamber.

* * * * *